US007757728B2

(12) United States Patent
Gruber

(10) Patent No.: US 7,757,728 B2
(45) Date of Patent: Jul. 20, 2010

(54) FUNNEL WITH SHUT OFF VALVE

(75) Inventor: Jennifer Gruber, Stillwater, MN (US)

(73) Assignee: Inspired Technologies, Inc., Le Sueur, MN (US)

( * ) Notice: Subject to any disclaimer, the term of this patent is extended or adjusted under 35 U.S.C. 154(b) by 385 days.

(21) Appl. No.: 11/743,351

(22) Filed: May 2, 2007

(65) Prior Publication Data

US 2008/0271813 A1 Nov. 6, 2008

(51) Int. Cl.
*B65B 1/30* (2006.01)

(52) U.S. Cl. ..... 141/201; 141/204; 141/344

(58) Field of Classification Search ..... 141/199, 141/201, 203, 204, 331, 344, 345, 335, 336
See application file for complete search history.

(56) References Cited

U.S. PATENT DOCUMENTS 1,293,575 A 2/1919 Tapman
2,715,488 A 8/1955 Conlon
3,938,563 A * 2/1976 Gall ..... 141/298
4,637,426 A * 1/1987 Lyon ..... 137/433
4,712,595 A 12/1987 Wilson
5,277,233 A * 1/1994 Fleming ..... 141/201
5,458,168 A 10/1995 Lindgren

* cited by examiner

*Primary Examiner*—Gregory L Huson
*Assistant Examiner*—Jason K Niesz
(74) *Attorney, Agent, or Firm*—Kagan Binder, PLLC

(57) ABSTRACT

A funnel with a shut-off valve terminates the flow of fluid from a reservoir to a spout passageway upon activation of the shut-off valve. The flow of fluid is terminated when a float contacts a seal mounted within the spout passageway. An upper magnet is mounted above the seal and a lower magnet is attached to the float, a portion of which extends over the lower magnet. In the open position, the force provided between the magnets serves to provide lift to the float. When the fluid level in the container rises, additional lift is provided until the lower magnet comes sufficiently within the range of the upper magnet causing the lower magnet to be drawn to the upper magnet. The force between the magnets is sufficient to provide compression of the seal by the float. A ball joint is provided between a control rod and the float to correct misalignment between the float and the seal. A significant portion of the float extends beyond the lower end of the spout passageway to reduce the influence of forces on the float. In addition, flanges are provided at the lower end of the float to direct fluid away from the float preventing premature closing of the valve.

8 Claims, 4 Drawing Sheets

FUNNEL WITH SHUT OFF VALVE

BACKGROUND OF THE INVENTION

The invention relates to an improved funnel with a shut-off valve. Although use of a funnel can often make it easier to fill a container with fluid and helps to prevent spills, when a funnel is placed within the opening of a container, it is often difficult or impossible for the user to view the amount of fluid in the container. Without a view of the fluid in the container, if the capacity of the container is improperly estimated, the user will often overfill the container and spillage occurs. In addition to the inconvenience caused by such spills, when certain liquids are poured the spills can be hazardous. The funnel of the present invention provides a shut-off valve which prevents spills caused by overfilling of the container.

Attempts to provide funnels with shut off valves have previously been made as shown in U.S. Pat. No. 4,712,595 ("the '595 patent") and U.S. Pat. No. 5,458,168 ("the '168 patent"). Each of these patents provides for the use of a single permanent magnet and a magnetically attractable element to close a valve. In order to maintain the valve in a closed position, the force of the magnet must overcome the weight of the float along with downward forces acting on the float. The '168 patent teaches the use of a spring to compensate for the weight of the float in order to improve the effectiveness of the valve. In order to function properly, however, the spring force associated with the spring must be provided in a relatively narrow range. If the spring force is too great, it will be difficult to maintain the valve in an open position during the filling process. If the spring force is too small, it will not sufficiently compensate for the weight of the spring. In addition, once the float has been raised, the spring provides less lift to the float. Finally, the spring is inconveniently provided in the funnel reservoir therefore is subjected to the fluid to be provided to the container. Upon draining the fluid from the funnel fluid remains on the spring creating a difficult surface to clean.

Another problem encountered is providing a valve which is consistently activated at a predetermined fluid level within the container to be filled. Although it is desired that the valve is activated solely in response to the fluid level in the container, several other factors impact the closure of the valve. For example, the flow rate of the fluid through the funnel, the viscosity of the fluid flowing through the funnel, and the temperature of the fluid flowing through the funnel are all factors which impact closure of the valve. In order to provide a valve which consistently closes at a predetermined fluid level within the container, it is desired that the influence of these other factors be minimized.

A specific problem recognized in the '168 patent is that fluid flowing through the spout can form a liquid column which acts on the float causing premature closure of the valve. The '168 patent purports to solve this problem by constricting the flow of fluid from the upper portion of the funnel to the spout. As a result of the constriction, however, the time necessary to fill the container is undesirably increased. In addition, air holes are provided in the spout of the '168 patent to reduce the possibility of air forming a subpressure on the upper side of the float. As recognized in the '168 patent, however, these air holes create the risk of fluid flowing out of the holes to the outer surface of the funnel. Such leaking of the funnel is undesirable especially when hazardous fluids are being handled.

Yet another problem encountered, is providing a valve which allows for a fluid tight seal, eliminating leakage at the valve site.

Finally, another problem encountered is maintaining the valve in the closed position, despite inadvertent contact with the funnel.

OBJECTS AND SUMMARY OF THE INVENTION

A general object of the present invention is to provide a funnel including a shut-off valve which is closed in response to a level of fluid in a container.

Another object of the present invention is to provide a funnel in which the valve is consistently closed when fluid in the container reaches a certain level.

A further object of the invention is to provide a funnel in which the valve provides a fluid tight seal despite misalignment at the valve site.

Yet a further object of the present invention is to provide a funnel which can be easily manufactured.

Briefly and in accordance with the forgoing, the present invention provides a funnel having an effective and reliable shut-off valve which can be used to fill a variety of containers while preventing spills due to overfilling of the containers. The funnel generally includes a reservoir portion and a spout portion. A float is provided in a spout passageway and moves from an open position to a closed position. An upper permanent magnet is mounted within the funnel above a seal and a lower permanent magnet is mounted to the float, below the seal.

The funnel is mounted within an opening of a container such that the spout of the funnel is positioned within the container. To begin the filling process, the float is placed in the open position. In this open position, the magnetic force provided by the magnets provides lift to the float.

The funnel provides consistent closure at predetermined fluid levels within the container to be filled. When the float is in the open position, a significant portion of the float extends beyond the spout thereby minimizing the influence of factors other than the fluid level in the container on the valve. In addition, flanges are provided to prevent the formation of liquid columns which may influence closure of the valve.

As the fluid level rises, in the container, the float is lifted and moves upwardly through the spout passageway. When the float has been sufficiently lifted, the lower magnet comes sufficiently close to the upper magnet, and the upper magnet draws the lower magnet along with the float upward. The float travels upward until the upper surface of the float contacts the seal thereby terminating the flow of fluid from the reservoir to the spout passageway. A ball and joint connection is provided to allow for movement of the float, thereby allowing for correction of any misalignment between the float and the seal.

The force provided by the two permanent magnets results in an effective and reliable valve. Furthermore, the magnetic force is of sufficient strength to provide compression to the seal, further increasing the reliability of the seal.

Unlike prior art funnels which require the use of air holes to prevent undesired lift caused by liquid columns formed between the lower surface of the float and the surface of the fluid in the container, the present invention eliminates the formation of liquid columns through flanges provided at the lower end of the float.

DETAILED DESCRIPTION OF THE ILLUSTRATED EMBODIMENT

Figure 1:
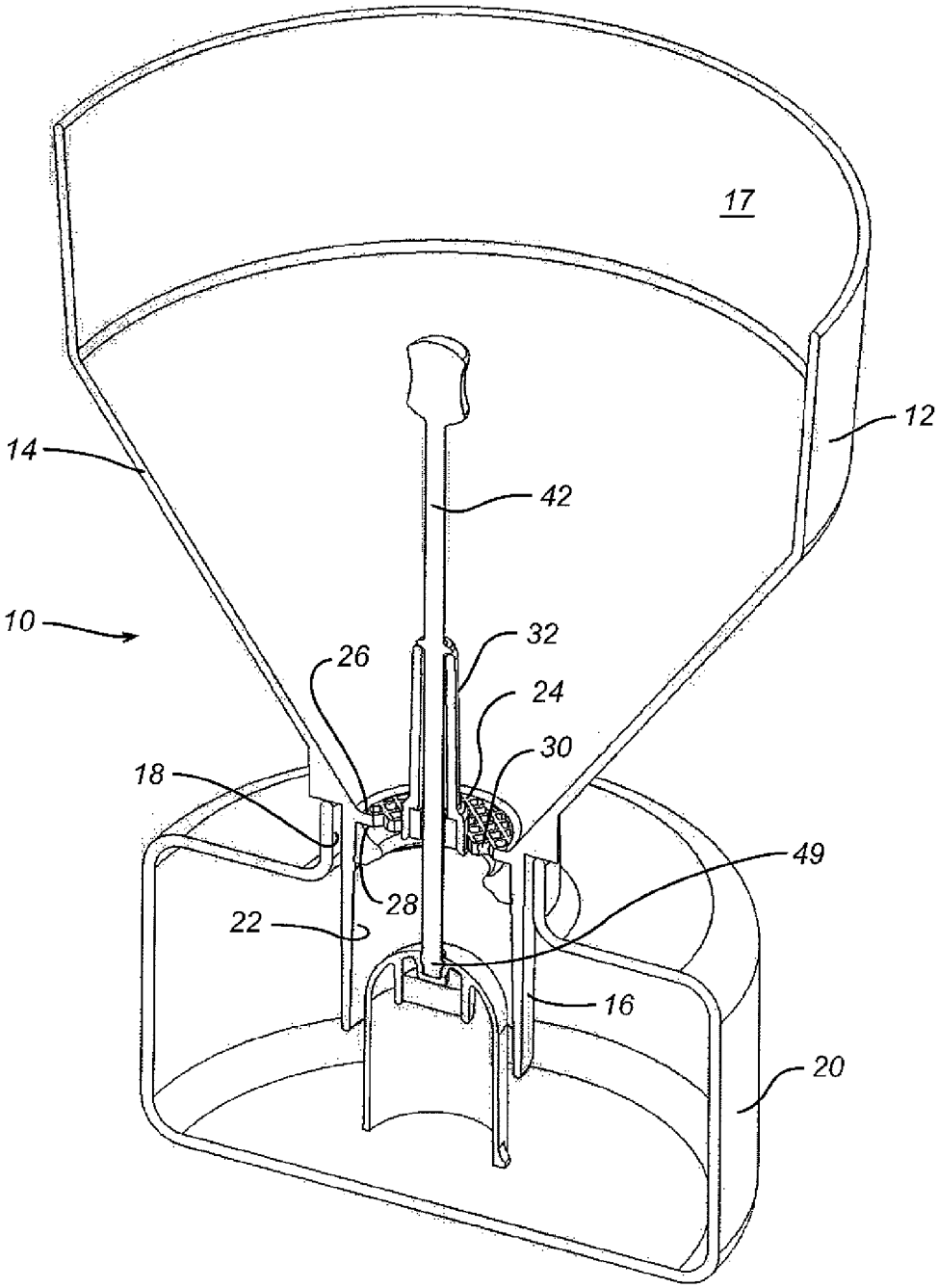
FIG. 1 is a cross-sectional perspective view of a preferred embodiment of the funnel of the present invention mounted on a container to be filled.

A preferred embodiment of the funnel 10 of the present invention is shown in FIGS. 1-4. The funnel includes a side wall 12 including a reservoir portion 14 and a spout portion 16 extending downwardly from the reservoir portion 14. The reservoir portion 14 is generally cone-shaped and defines a reservoir 17 for receiving fluid. The spout 16 is generally cylindrically-shaped and is sized appropriately to fit within an opening 18 of a container 20 to be filled with fluid. The spout portion 16 of the side wall 12 defines a spout passageway 22 in fluid communication with the reservoir 17.

As best shown in FIG. 1, a generally disk-shaped strainer 24 is provided at the lower end of the reservoir 17. The strainer 24 includes an upper surface 26 and a lower surface 28. A plurality of apertures 30 extend from the upper surface 26 to the lower surface 28 through which fluid can pass from the reservoir 17 to the spout passageway 22.

A generally cylindrically-shaped sleeve 32 extends upwardly from the center of the strainer 24. The sleeve 32 includes an upper end 34 and an enlarged lower end 36. A centrally located, elongated control rod passage 38 is defined by the sleeve 32 and an upper magnet cavity 40 is defined by the enlarged lower end 36.

The side wall 12, strainer 24 and sleeve 32 are preferably unitarily molded from plastic. The strainer 24 and sleeve 32 are configured to minimize the obstruction between the reservoir 17 and the spout passageway 22, thereby maximizing the flow of fluid from the reservoir 17 to the spout passageway 22.

An elongated control rod 42 is positioned within the sleeve 32 and provides an upper end 44 and a lower end 46. The diameter of the control rod 42 is slightly smaller than the diameter of the control rod passageway 38 of the sleeve 32 to allow slidable movement between the control rod 42 and the sleeve 32. An enlarged head 48 is provided at the upper end 44 of the control rod 42 and a ball 49 is provided at the lower end of the control rod 42 for connecting a float 50 to the control rod. An outwardly extending stop flange 52 is provided intermediate the upper end 44 and lower end 46 of the control rod 42. The diameter of the stop flange 52 is larger than the diameter of the control rod passageway 38 of the sleeve 32.

The float 50 includes a generally cylindrically-shaped side wall 54 and a dome-shaped upper end 56. A cavity 57 is provided in the upper surface of the float 50 to receive the ball 49 of the control rod 42. A float cavity 58 is defined by the side wall 54 and upper end 56 of the float 50. A lower magnet retainer 60 extends downwardly from the upper end 56 of the float 50 within the float cavity 58. A plurality of flanges 62 extend outwardly from the outer surface of the float 50 at a lower end 64 thereof.

An annular-shaped seal 66 is position within the spout 16 below the strainer 24. The seal 66 includes an inwardly projecting ridge 68 and is formed from a resilient, compressible material.

A generally ring-shaped upper permanent magnet 70 is positioned within the upper magnet cavity 40 of the sleeve 32. A passageway 72 is provide through the upper magnet 70 and is appropriately sized to allow the control rod 42 to move within the passageway.

A generally disc-shaped lower permanent magnet 74 is positioned within the magnet retainer 60 of the float 50 and is aligned beneath the upper magnet 70. The upper and lower magnets 70,74 are preferably a neodymium magnets. The poles of the upper and lower magnets 70,74 are positioned such that an attractive force is provided between the upper and lower magnets 70,74.

The funnel 10 is assembled as follows. As noted above the side wall 12, strainer 24 and sleeve 32 are unitarily molded from plastic. The ring shaped upper permanent magnet 70 is inserted into the magnet cavity of the sleeve 32 and retained therein by a friction fit for example. Next, the seal 66 is inserted through the spout 16, positioned beneath the strainer 24 and secured to the side wall 12. Next, the control rod 42 is passed through the upper end 34 of the of the sleeve 32 and beyond the seal 66. Next the lower permanent magnet is positioned in the lower magnet retainer 60 and retained therein by friction fit for example. Finally, the upper end 56 of the float 60 is positioned within the spout 16 and the ball 49 is snap fit within the cavity 57 in the upper surface 56 of the float 50 to form a ball joint. Upon assembly of the funnel, the control rod 42 moves upward and downward within the sleeve 32. In addition, the ball joint connection between the float 50 and the control rod 42 provides for swiveling motion between the float 50 and the control rod 42.

Figure 2:
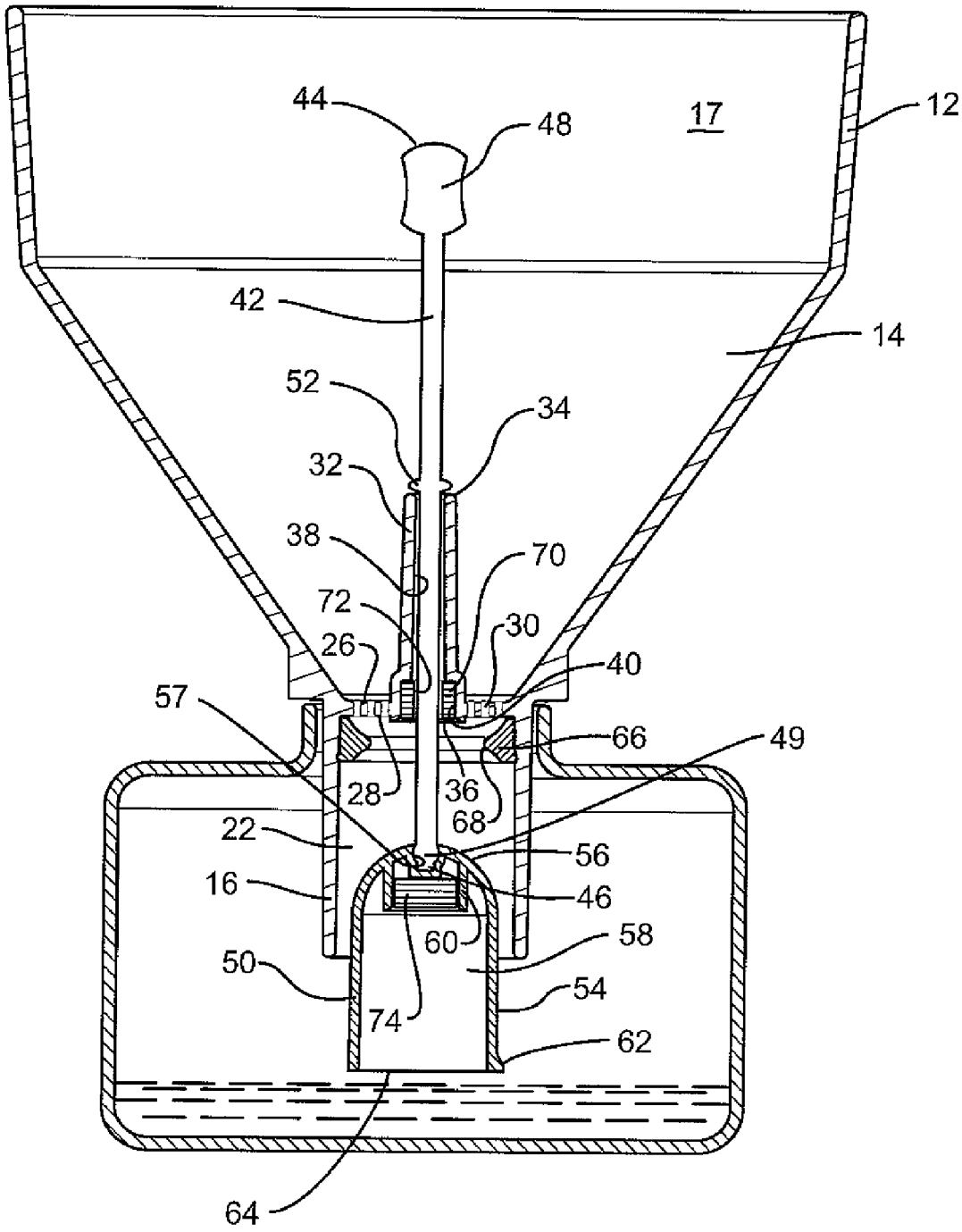
FIG. 2 is cross-sectional view of the funnel of FIG. 1 in an open condition.

Use of the funnel begins by placing the spout 16 of the funnel 10 within an opening 18 of the container 20 to be filled. The user pushes downwardly on the head 48 of the control rod 42. When the user overcomes the magnetic force between the upper magnet 70 and the lower magnet 74, the control rod 42 and float 50 slide downwardly within the control rod passageway 38 of the sleeve 32 until the stop flange 52 of the control rod 42 contacts the upper end 34 of the sleeve 32. At this point the float 50 is in the open position as shown in FIG. 2. As mentioned above, the upper and lower magnets 70,74 are preferably neodymium magnets and therefore provide a strong magnetic force. In the open position, a significant portion of the float 50 extends beyond the lower end of the spout 16. As a result, a relatively large air gap is provided between the upper and lower magnets 70,74. Given the strength of the attractive magnetic force provided by the upper and lower magnets 70,74, even in this open position lift is provided to the float 50.

With the float 50 in the open position, the user can begin to fill the container 20. The user pours fluid into the reservoir 17 and the fluid flows through the passageways 30 of the strainer 24, past the seal 66, through the spout passageway 22 and into the container 20. A significant portion of the float 50 extends beyond the lower end of the spout 16 leaving only a small portion of the float within the spout passageway 22. As fluid flows through the passageway 22, it encounters the upper surface 56 of the float 50. The dome-shaped upper surface 56 allows for easy passage of the fluid through and out of the passageway 22.

As liquid flows through the spout 16 along the float 50, the flanges 62 at the lower end 64 of the float 50 direct the fluid away from the lower end 64 of the float 50 to prevent a liquid column from forming between the lower end of the spout 50 and the upper surface of liquid in the container.

As the fluid level in the container 20 rises, the fluid will contact the lower end 64 of the float 50 providing lift to the float 50, the lower magnet 74 and the control rod 42. As the float 50, the lower magnet 74 and the control rod 42 are lifted, the control rod 42 slides within the control rod passageway 38 of the sleeve 32. The sleeve 32 guides the float 50, to prevent the float 50 from contacting the spout portion 16 of the side-wall 12 of the funnel 10.

Figure 3:
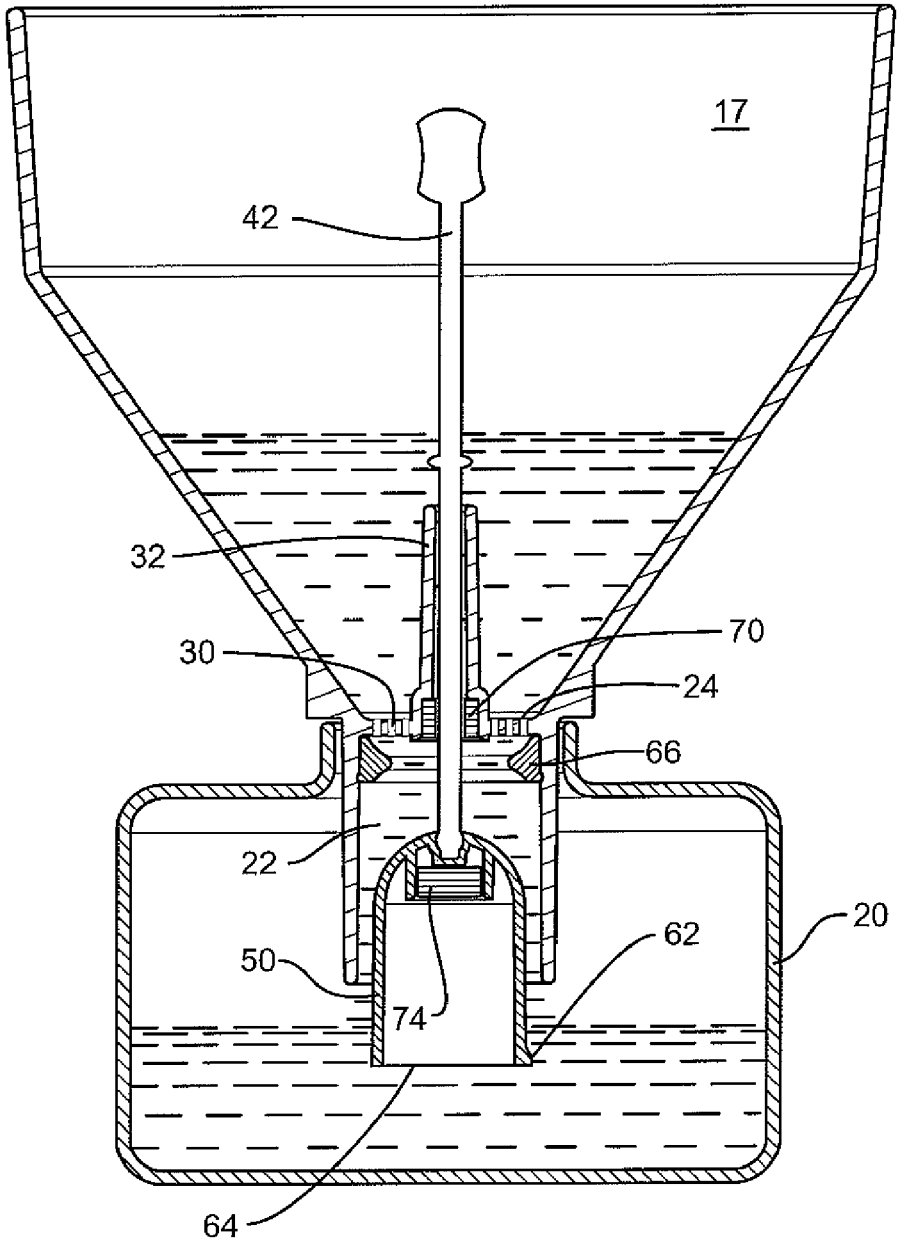
FIG. 3 is a cross-sectional view of the funnel of FIG. 1 in an open condition and with fluid flowing therethrough.
Figure 4:
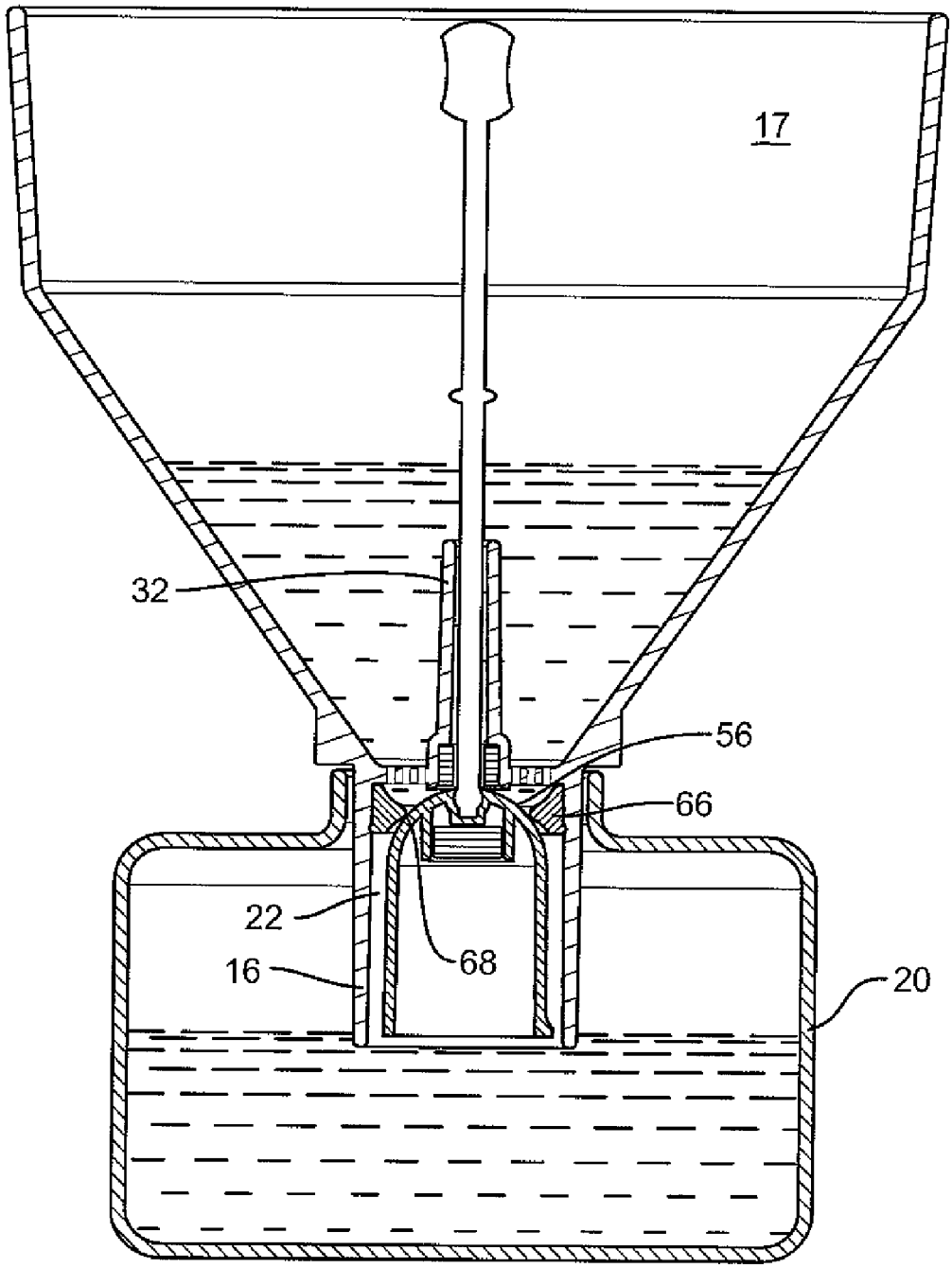
FIG. 4 is a cross-sectional view of the funnel of FIG. 1 in a closed condition.

As shown in FIG. 3, as the fluid level continues to rise, sufficient lift is provided such that the lower magnet 74 comes sufficiently within the range of the upper magnet 70 to draw the lower magnet 74 along with the float 50 and the control rod 42 toward the upper magnet 70. When the lower magnet 74 is sufficiently within range, the attractive magnetic force quickly draws the lower magnet 74 toward the upper magnet 70 until the upper surface 56 of the float 50 contacts the seal 66. Misalignment may cause a portion of the upper surface 56 of the float 50 to contact a first portion of the seal 66 while leaving a gap between the upper surface 56 and a second portion of the seal 66. The ball joint connection between the control rod 42 and the float 50 allows the float 50 to swivel. The magnet force between the upper and lower magnets 70, 74 will cause such swiveling to occur until the circumference of the seal 66 is in contact with the upper surface 56 of the float 50, eliminating any gap between the seal 66 and the upper surface 56 of the float 50, thereby restricting the flow of fluid from the reservoir 17 to the spout passageway 22. At this point the float 50 is in the closed position as shown in FIG. 4. As shown in FIG. 4, in the closed position, a portion of the dome-shaped upper surface 56 of the float extends through the seal 66. The attractive magnetic force between the upper and lower magnets 70, 74 is sufficient to cause compression of the seal 66 by the upper surface 56 of the float 50. More specifically, as the float 50 is drawn through the aperture of the seal 66 and the surface 56 of the float contacts the ridge 68 of the seal 66, the seal 66 is not only compressed upwardly, it is also compressed in a radially outwardly direction. Preferably, compression of the seal occurs at an angle of approximately 45 degrees. As a result of the contact between the float 50 and the seal 66, a reliable fluid-tight shut-off valve is formed between the reservoir 17 and the spout passageway 22 and container 20.

When in the closed position, the contents remaining in the reservoir 17 of the funnel 10 can be transferred hack into the source container. Alternatively, the funnel 10 can be transferred to another container to be filled. The magnetic force provided between the upper and lower magnets 70, 74 securely holds the float 50 in the closed position such that no leakage of fluid occurs from the reservoir 17 as the funnel is transferred to another container. Upon mounting the funnel 10 on the new container to be filled, the user can push downwardly on the control rod 42 to open the funnel 10 at which point fluid will again flow through the spout passageway 22. In addition, the magnetic force between the upper and lower magnets 70, 74 is sufficient to maintain the valve in the closed position even when impact occurs with the funnel.

As shown in the drawings the funnel 10 of the present invention is of minimal complexity and is therefore easily manufactured and assembled as described above. The funnel 10 of the present invention also provides several advantages over funnels with shut off valves previously known. The strong magnetic force provided between the upper and lower magnets 70, 74 not only provides lift when the valve is in the open condition but also allows the valve to be closed quickly in response to a relatively minimal upward lift provided by the float 50. The strong magnetic forces also provide for compression of the seal 66 by the dome-shaped upper surface 56 of the float 50. Compression not only occurs due to upward forces on the seal 66 but also due to radially directed forces. As a result, a reliable fluid tight seal is provided, eliminating leakage of fluid from the reservoir 17 upon closure of the valve.

The funnel 10 further provides a valve which minimizes the forces acting on the float 50 and therefore consistently provides closure of the valve when a certain fluid level is reached within the container 20. Ideally, the point at which the valve closes is solely dependent on the level of fluid in the container to be filled. In this manner, the valve consistently closes at the same fluid level. In reality, however, other forces (e.g the rate of fluid flow, the temperature of the fluid, and the viscosity of the fluid) also impact closure of the valve. These forces come into play as the fluid flows around the float 50, within the spout passageway 22. As the fluid exits the spout passageway 22, the impact on the float 50 is significantly diminished. Thus, by placing a significant portion of the float 50 beyond the spout 16, the impact of these other forces is minimized. As a result, closure of the valve occurs consistently at essentially the same fluid level in the container. In addition to removing a large portion of the float from within the spout, the upper surface 56 of the float 50 is dome-shaped and therefore further reduces the forces acting on the float.

As described in the '168 patent, a liquid column can form between the lower end of the float and the surface of the fluid in the container. As a result, undesired lift is provided to the float, causing the valve to close prematurely. As described above, the float 50 of the funnel 10 includes flanges 62 to prevent formation of a liquid column between the float 50 and the surface of the fluid in the container 20 without requiring holes to be provided through the side wall 12 of the funnel 10.

As shown in the drawings, obstruction between the reservoir 17 and the spout passageway 22 is minimized so as to maximize the flow of fluid between the reservoir 17 and the spout passageway 22 thereby increasing the rate of flow to the container 20 when the float is in the open position. In addition, to minimizing the obstruction caused by the sleeve 32, the strainer 24 and the seal 66, the sleeve guides the control rod 42 to eliminate contact between the float 50 and the interior surface of the spout portion 16 of the side wall 12. If misalignment occurs between the float 50 and the seal 66, for example due to a bend in the control rod 42, the ball joint provided between the float 50 and control rod 42 will correct the misalignment.

Prior art funnels require contact between the magnetic element and a second element (e.g. a washer or a seal) to form the valve. As a result the configuration of the second element is limited by the shape of the magnetic element. The valve of the present invention does not require contact of a second element with a magnetic element to provide closure of the valve. Rather, the dome-shaped upper surface 56 of the float 50 contacts the ring-shaped seal 66. Therefore the configuration of the elements forming the valve is not limited by the shape of the magnetic element.

While a preferred embodiment of the present invention is shown and described, it is envisioned that one of ordinary skill in the art may devise various modifications of the present invention without departing from the spirit and scope of the appended claims.

What is claimed is:

1. A funnel for filling a container with fluid including:

a side wall defining a reservoir and a spout passageway;

a float movable within said spout passageway from an open position where the fluid can flow from the reservoir to the sprout passageway to a closed position where the fluid flow from the reservoir to the sprout passageway is restricted;

an upper permanent magnet secured to said side wall;

a lower permanent magnet secured to said float wherein at least a portion of the float is positioned above the lower permanent magnet so that when the funnel is in the closed position the upper and lower permanent magnets do not contact one another;

wherein when fluid is provided to the container through said reservoir and said spout passageway, said float is initially lifted in response to an increase in a fluid level in the container; and wherein the upper and the lower permanent magnets are sized and positioned to provide a magnetic force that is sufficient to lift the float to the closed position after the float is initially lifted by the fluid.

2. A funnel as defined in claim 1, further comprising a seal secured to said side wall and wherein in said closed position said float contacts said seal.

3. A funnel as defined in claim 2, wherein an aperture is defined by said seal and wherein a portion of said float extends through said aperture when said float is in said closed position.

4. A funnel as defined in claim 3, wherein when said float is in said closed position said seal is compressed in a radially outward direction

5. A funnel as defined in claim 1, wherein in said open position, said float extends beyond a lower end of said spout passageway.

6. A funnel as defined in claim 1, further comprising:

a control rod attached to said float and extending through said upper permanent magnet;

a sleeve attached to said side wall and defining a control rod passageway;

and wherein said control rod is slidably positioned within said control rod passageway.

7. A funnel as defined in claim 6, wherein said control rod is attached to said float through a ball joint.

8. A funnel as defined in claim 1, further including flanges at a lower end of said float.

* * * * *

UNITED STATES PATENT AND TRADEMARK OFFICE

CERTIFICATE OF CORRECTION

PATENT NO. : 7,757,728 B2
APPLICATION NO. : 11/743351
DATED : July 20, 2010
INVENTOR(S) : Jennifer Gruber and Robert Heil It is certified that error appears in the above-identified patent and that said Letters Patent is hereby corrected as shown below:

At item (75) of the title page, the Inventor(s), "Jennifer Gruber, Stillwater, MN (US)" should be -- Jennifer Gruber, Stillwater, MN (US); Robert Heil, Almena, WI (US) --

Signed and Sealed this
Tenth Day of March, 2015

Michelle K. Lee

Michelle K. Lee
*Deputy Director of the United States Patent and Trademark Office*